US006811819B2

(12) United States Patent
Joshi et al.

(10) Patent No.: US 6,811,819 B2
(45) Date of Patent: Nov. 2, 2004

(54) AQUEOUS ALKALINE ZINCATE SOLUTIONS AND METHODS

(75) Inventors: Nayan H. Joshi, Rock Hill, SC (US); Maulik D. Mehta, Charlotte, NC (US)

(73) Assignee: Atotech Deutschland GmbH (DE)

( * ) Notice: Subject to any disclaimer, the term of this patent is extended or adjusted under 35 U.S.C. 154(b) by 0 days.

(21) Appl. No.: 10/806,839

(22) Filed: Mar. 23, 2004

(65) Prior Publication Data

US 2004/0173467 A1 Sep. 9, 2004

Related U.S. Application Data

(62) Division of application No. 10/265,864, filed on Oct. 7, 2002.

(51) Int. Cl.[7] ..... B05D 3/10; B05D 1/18; C23C 18/31

(52) U.S. Cl. ..... 427/307; 427/436; 106/1.17; 106/287.18

(58) Field of Search ..... 106/1.17, 287.18; 427/436, 307; 205/244, 305, 323

(56) References Cited

U.S. PATENT DOCUMENTS 4,134,804 A * 1/1979 Zehnder et al. ..... 205/310
4,366,036 A * 12/1982 Lash et al. ..... 205/310
4,536,261 A * 8/1985 Popescu ..... 205/310
4,904,354 A * 2/1990 Stavitsky et al. ..... 205/176
4,983,263 A * 1/1991 Yasuda et al. ..... 205/246
5,182,006 A * 1/1993 Haydu et al. ..... 205/213
5,405,523 A * 4/1995 Eckles ..... 205/245
5,578,187 A * 11/1996 Zitko et al. ..... 205/191
6,080,447 A * 6/2000 Ferroni et al. ..... 427/321
6,162,343 A * 12/2000 Takami et al. ..... 205/119
6,500,886 B1 * 12/2002 Yamamuro et al. ..... 524/99
6,652,728 B1 * 11/2003 Sonntag et al. ..... 205/143
2002/0100694 A1 * 8/2002 Morin et al. ..... 205/170

FOREIGN PATENT DOCUMENTS

GB 1007252 * 10/1965

* cited by examiner

*Primary Examiner*—Helene Klemanski
(74) *Attorney, Agent, or Firm*—Renner, Otto, Boisselle & Sklar, LLP

(57) ABSTRACT

The present invention relates to methods for depositing zincate coatings on aluminum and aluminum alloys comprising applying an immersion zincate coating on an aluminum or aluminum alloy substrates, optionally followed by plating the zincate coated aluminum or aluminum alloy substrate using an electroless or electrolytic metal plating solution. The present invention also relates to an improved aqueous alkaline zincate solution comprising hydroxide ions, zinc ions, nickel ions and/or cobalt iron ions, copper ions, and at least one inhibitor containing one or more nitrogen atoms, sulfur atoms, or both nitrogen and sulfur atoms provided said nitrogen atoms are not present in an aliphatic amine or hydroxylamine.

40 Claims, No Drawings

AQUEOUS ALKALINE ZINCATE SOLUTIONS AND METHODS

CROSS-REFERENCE TO RELATED APPLICATIONS

The present application is a division of, and claims priority under 35 USC §122, copending, commonly assigned U.S. application Ser. No. 10/265,884 filed Oct. 7, 2002.

FIELD OF THE INVENTION

This invention relates to aqueous alkaline zincate solutions and to a process for depositing a zincate coating on aluminum or aluminum alloy substrates. The invention also relates to metal plated aluminum or aluminum alloy substrates.

BACKGROUND OF THE INVENTION

One of the fastest growing worldwide markets is the processing and plating of aluminum and its alloys. Aluminum's unique physical and mechanical characteristics make it particularly attractive for industries such as automotive, electronics, telecommunications, avionics, along with a plethora of decorative applications. Among aluminum's most endearing properties include it's low overall density (2.7 g/cc), high mechanical strength achieved through alloying and heat treating, and its relatively high corrosion resistance. Additional properties include; high thermal and electrical conductance, its magnetic neutrality, high scrap value, and its amphoteric chemical nature. Most aluminum components are made from aluminum alloys with alloying elements including: silicon, magnesium, copper, etc. These alloying mixes are formed in order to achieve enhanced properties such as high-strength or ductility.

The plating of aluminum and its alloys require specific surface preparations for successful electrolytic and electroless deposition. The most common practice used in order to achieve successful electrodeposition is applying an immersion zinc coating (better known as zincate) to the substrate just prior to plating. This procedure has long been considered the most economical and practical method of pretreating aluminum. The major benefits of applying a zincate layer for pretreatment are the relative low cost of equipment and chemistry, wider operating windows for processing, and ease of applying a controlled deposit.

The presence of other metals in the zincate solutions has an affect on the rate and efficacy of the zinc deposition. Small amounts of alloy components (i.e. Fe, Ni, Cu) improve not only the adhesion of the zincate deposit, but also increase the usability of the zincate on a variety of aluminum alloys. Hence, the addition of Fe ions improves the adhesion on magnesium containing alloys. The presence of nickel in the zincate improves the adhesion of nickel plated directly onto the zincate, and similar effects can be found with addition of copper in the zincate and subsequent copper plate. In general, however, the alloying of zincate has shown to provide thinner and more compact deposits which effectively translate into better adhesion of downstream electroless/electrolytic plating. On the other hand, the composition of an alloying zincate becomes more and more complicated with the additional metal ions in the composition. It makes selection of complexing agents more complicated and critical for the overall performance of the zincate. Zinc-iron-nickel compositions are more sensitive than zinc-iron compositions for the selection of complexing agents and ratio of metal ions in the composition. This becomes even more critical with the addition of the cooper ions in the alloy zincate. Due to its noble position in the galvanic series, the deposition rate of copper in the immersion zincate deposition is much higher than the other elements in the zincate. Therefore, control of the deposition rate of copper becomes important. It is possible to control the deposition rate of copper by the selection of the right complexing agent(s) for copper ions and adequate ratio with the other metal ions. There are few strong complexing agents for copper ions which offer good stability and performance of the alloying zincate, and cyanide appears to be the best candidate. Cyanide is a complexer of choice for the copper containing zincate compositions and it has been the industry standard for that application for many years. A negative aspect for the use of cyanide is the extremely toxic nature of cyanide, and therefore, like other metal finishing products, the search for a cyanide replacement in the alloying zincate has been a topic of interest for many years.

SUMMARY OF THE INVENTION

The present invention provides an improved aqueous alkaline zincate solution comprising hydroxide ions, zinc ions, nickel ions and/or cobalt ions, iron ions, copper ions, and at least one inhibitor containing one or more nitrogen atoms, sulfur atoms, or both nitrogen and sulfur atoms provided said nitrogen atoms are not present in an aliphatic amine or hydroxylamine. The present invention also relates to methods for depositing zincate coatings on aluminum and aluminum alloys comprising applying an immersion zincate coating on an aluminum or aluminum alloy substrate, optionally followed by plating the zincate coated aluminum or aluminum alloy substrate using an electroless or electrolytic metal plating solution.

DETAILED DESCRIOTION OF THE INVENTION

The present invention, in one embodiment, relates to aqueous alkaline zincate solutions, and more particularly to aqueous alkaline zincate solutions which are useful for depositing a zincate coating on aluminum and various aluminum based alloy substrates. Thus, in one embodiment, the aqueous alkaline zincate solutions of the invention comprise hydroxide ions, zinc ions, nickel and or cobalt ions, iron ions, copper ions, and at least one inhibitor containing one or more nitrogen atoms, sulfur atoms, or both nitrogen and sulfur atoms provided said nitrogen atoms are not present in an aliphatic amine or hydroxylamine. In another embodiment, the aqueous alkaline zincate solutions of the present invention are free of cyanide ions, and the zincate solutions may contain one or more metal complexing agents and nitrate ions.

The aqueous alkaline zincate solutions of the present invention may be prepared by dissolving water soluble salts of the desired metals in water. Thus, examples of the source of the zinc ions in the zincate solutions may be zinc oxide, zinc nitrate, zinc chloride, zinc sulfate, zinc acetate, etc.

Nickel ions can be introduced into the zincate solutions by dissolving nickel salts such as nickel chloride, nickel nitrate, nickel sulfate, etc. Cobalt ions may be introduced as cobalt chloride, cobalt nitrate, cobalt sulfate, etc. Salts of iron which are useful in introducing the iron ions include ferrous chloride, ferric chloride, ferrous sulfate, ferric sulfate, ferrous nitrate, ferric nitrate, etc. The copper ions may be introduced by dissolving salts such as cuprous chloride, cuprous nitrate, cupric nitrate, cupric chloride, cuprous sulfate, cupric sulfate, etc. in water.

In one embodiment, the zincate solutions contain nickel ions but no cobalt ions. In another embodiment the zincate solutions contain nickel ions and cobalt ions. In yet another embodiment the zincate solutions contain cobalt but no nickel ions. Because of economics, the zincate baths generally contain only nickel ions or a mixture of nickel with a small amount of cobalt.

The zincate solutions of the present invention also contain hydroxide ion introduced generally as an alkali metal hydroxide such as potassium hydroxide or sodium hydroxide.

In one embodiment, the aqueous alkaline zincate solutions of the present invention will comprise from about 5 to about 300 g/l of hydroxide ions, from about 1 to about 30 g/l of zinc ions, from about 0.1 to about 5.0 g/l of iron ions, from about 0.01 to about 10 g/l of copper ions, and from about 0.05 to about 20 g/l of nickel and/or cobalt ions.

In another embodiment, the zincate solutions of the present invention may comprise from about 5 to about 35 g/l or even up to 100 g/l of hydroxide ions, from about 1 to about 15 g/l of zinc ions, from about 1 to about 3 g/l of iron ions, from about 0.01 to about 3 g/l of copper ions, and from about 0.05 to about 10 g/l of nickel and/or cobalt ions.

In one embodiment, the concentration of zinc ions is greater than the combined concentration of iron ions, copper ions, and nickel and/or cobalt ions. The zincate solutions of the invention also generally contain nitrate ions introduced as soluble nitrate salts. Examples of useful salts include sodium nitrate, potassium nitrate, etc. The concentration of nitrate anions, when present in the zincate solutions may range from about 0.01 to about 8 g/l.

The aqueous alkaline zincate solutions of the present invention also contain at least one inhibitor containing one or more nitrogen atoms, one or more sulfur atoms, or both nitrogen and sulfur atoms, provided such nitrogen atoms are not present in an aliphatic amine or hydroxylamine. In another embodiment, the zincate compositions of the invention also contain one or more metal complexing agents in combination with the inhibitor. Such compositions offer improved stability of the complex system and acceptable performance on a variety of aluminum alloys. In yet another embodiment, the zincate solutions are free of cyanide ions, and such solutions offer the additional advantage of environmentally friendly application for the pretreatment of various metal substrates such as aluminum and aluminum based alloys.

The inhibitors useful in the zincate solutions of the present invention may be selected from a wide variety of compositions which contain nitrogen and/or sulfur atoms. Thus, in one embodiment, the inhibitor may be selected from one or more compounds characterized by the formula

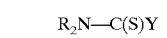

$$R_2N—C(S)Y \quad \text{I}$$

wherein each R is independently hydrogen or an alkyl, alkenyl or aryl group, and Y is $XR^1$, $NR_2$ or $N(H)NR_2$ where X is O or S, and $R^1$ is hydrogen or an alkali metal. Examples of such compounds include thioureas, thiocarbamates, and thiosemicarbazides.

The thiourea compounds which may be utilized in the present invention may be characterized by the formula:

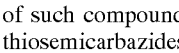

$$[R_2N]_2CS \quad \text{(II)}$$

wherein each R is independently hydrogen or an alkyl, cycloalkyl, alkenyl or aryl group. The alkyl, cycloalkyl, alkenyl and aryl groups may contain up to ten or more carbon atoms and substituents such as hydroxy, amino and/or halogen groups. The alkyl and alkenyl groups may be straight chain or branched. The thioureas used in the present invention comprise either thiourea or the various art recognized derivatives, homologes or analogs thereof. Example of such thioureas include thiourea, 1,3-dimethyl-2-thiourea, 1,3-dibutyl-2-thiourea, 1,3-didecyl-2-thiourea, 1,3-diethyl-2-thiourea, 1,1-diethyl-2-thiourea, 1,3-diheptyl-2-thiourea, 1,1-diphenyl-2-thiourea, 1-ethyl-1-(1-naphthyl)2-thiourea, 1-ethyl-1-phenyl-2-thiourea, 1-ethyl-3-phenyl-2-thiourea, 1-phenyl-2-thiourea, 1,3-diphenyl-2-thiourea, 1,1,3,3-tetramethyl-2-thiourea, 1-allyl-2-thiourea, 3-allyl-1,1-diethyl-2-thiourea and 1-methyl-3-hydroxyethyl-2-thiourea. 2,4-dithiobiuret, 2,4,6-trithiobiuret, alkoxy ethers of isothiourea, etc.

The thiocarbamates which can be utilized as inhibitors in the zincate solutions of the present invention include thiocarbamates represented by the formula $$R_2NC(S)—XR^1 \quad \text{III}$$

wherein each R is independently hydrogen, or an alkyl, alkenyl, or aryl group, X is O or S, and $R^1$ is hydrogen or an alkali metal. The alkyl and alkenyl groups may contain from about 1 to about 5 carbon atoms. In another embodiment, the alkyl groups can each contain 1 or 2 carbon atoms. In yet another embodiment, both R groups are alkyl groups containing 1 or 2 carbon atoms. Examples of such thiocarbamates include dimethyl dithiocarbamic acid, diethyl dithiocarbamic acid, sodium dimethyldithiocarbamate hydrate, sodium diethyldithiocarbamate trihydrate, etc.

The thiosemicarbazides which can be utilized as inhibitors in the zincate solutions of the present invention include thiosemicarbazides represented by the formula $$R_2N—C(S)—N(H)NR_2 \quad \text{IV}$$

wherein each R is independently hydrogen or an alkyl, alkenyl or aryl group. In one embodiment, the R groups are alkyl groups containing from 1 to 5 carbon atoms, and in another embodiment, the alkyl groups can each contain 1 or 2 carbon atoms. Examples of such thiosemicarbazides include 4,4-dimethyl-3-thiosemicarbazide and 4,4-diethyl-3-thiosemicarbazide.

The aqueous alkaline zincate solutions of the present invention also may contain, as inhibitors, one or more nitrogen-containing disulfides such as those represented by the formula $$[R_2NCS_2]_2 \quad \text{V}$$

wherein each R is independently hydrogen, or an alkyl, alkenyl or aryl group. The alkyl groups may contain from 1 to about 5 carbon atoms. In another embodiment, the alkyl groups can each contain one or two carbon atoms. In another embodiment, both R groups are alkyl groups containing one or two carbon atoms. Examples of such organic disulfides include bis(dimethylthiocarbamyl) disulfide(thiram) bis (diethylthiocarbamyl) disulfide, etc.

The inhibitors which are useful in the present invention also may be nitrogen-containing heterocyclic compounds which may be substituted or unsubstituted. Examples of substituents include alkyl groups, aryl groups, nitro groups, mercapto groups, etc. The nitrogen-containing heterocyclic compounds may contain one or more nitrogen atoms, and examples of such nitrogen-containing heterocyclic compounds include pyrroles, imidazoles, benzimidazoles, pyrazoles, pyridines, dipyridyls, piperazines, pyrazines, piperidines, triazoles, benzotriazoles, tetrazoles, pyrimidines, etc. The nitrogen-containing heterocyclic compounds may also contain other atoms such as oxygen or sulfur. An example of a heterocyclic compound containing nitrogen and oxygen is morpholine, and examples of nitrogen-containing heterocyclic compounds containing nitrogen and sulfur include rhodanines, thiazoles, thiazolines, and thiazolidines.

In one embodiment, the inhibitor comprises one or more of the above described nitrogen-containing heterocyclic compounds which are substituted with a mercapto group. Specific examples of mercapto substituted nitrogen-containing heterocyclic compounds useful as inhibitors in the zincate solutions of the present invention include: 2-mercapto-1-methyl imidazole; 2-mercaptobenzimidazole; 2-mercaptoimidazole; 2-mercapto-5-methyl benzimidazole; 2-mercaptopyridine; 4-mercaptopyridine; 2-mercaptopyrimidine (2-thiouracil); 2-mercapto-5-methyl-1,4-thiadiazole; 3-mercapto-4-methyl-4H-1,2,4-triazole: 2-mercaptothiazoline, 2-mercaptobenzothiazole, 4-hydroxy-2-mercaptopyrimidine; 2-mercaptobenzoxazole; 5-mercapto-1-methyltetrazole; and 2-mercapto-5-nitrobenzimidazole.

The inhibitors which are useful in the zincate solutions of the present invention also may include alkali metal thiocyanates such as sodium thiocyanate and potassium thiocyanate. Thio alcohols and thio acids also may be included in the zincate solutions of the invention as inhibitors. Examples of these inhibitors include: 3-mercapto ethanol; 6 mercapto-1-hexanol; 3-mercapto-1,2-propanediol; 1-mercapto-2-propanol; 3-mercapto-1-propanol; mercaptoacetic acid; 4-mercaptobenzoic acid; 2-mercaptopropionic acid; and 3-mercaptopropionic acid.

The zincate solutions of the present invention contain one or more of the above described inhibitors. In one embodiment, the zincate solutions contain two or more of the above described inhibitors. The amount of inhibitor included in the zincate solutions of the present invention may vary from about 0.001 to about 10 g/i or more.

The zincate solutions of the present invention also may contain one or more metal complexing agents. The complexing agents are useful for solubilizing the metal ions in the zincate solution. The amount of complexing agent included in the zincate solutions of the invention may range from about 5 to about 250 grams per liter or more. In one embodiment, the concentration of the complexing agent(s) is from about 20 to about 100 g/l. Useful complexing agents may be selected from a wide variety of materials including those containing anions such as acetate, citrate, nitrate, glycollate, lactate, maleate, pyrophosphate, tartrate, gluconate, glucoheptonate, etc. Mixtures of at least two complexing agents are particularly useful in the zincate solutions of the present invention. Specific examples of such complexing agents include tartaric acid, sodium tartrate, disodium tartrate, sodium gluconate, potassium gluconate, potassium acid tartrate, sodium potassium tartrate (Rochelle Salt), etc.

The metal complexing agents which may be included in the zincate solutions of the present invention also may comprise aliphatic amines, aliphatic hydroxylamines or mixtures thereof. In another embodiment, the complexing agents comprises a mixture of one or more aliphatic amine and/or aliphatic hydroxylamine and one or more of the other complexing agents described above. The amount of the amine included in the zincate solutions of the present invention may vary from about 1 to about 50 g/l. Examples of the amines which are useful include ethylenediamine, diaminopropane, diaminobutane, N,N,N,N-tetramethyldiaminomethane, diethylenetriamine, 3,3-aminobispropylamine, triethylene tetramine, monoethanolamine, diethanolamine, triethylanolamine, N-methyl hydroxylamine, 3-amino-1-propanol, N-methyl ethanolamine, etc.

The aqueous alkaline zincate solutions of the present invention may be prepared by dissolving the various components mentioned above in water. The components may be mixed with water in any order.

The following examples, illustrate the alkaline zincate solutions of the present invention. In these examples, the zinc, nickel, copper and iron are introduced as zinc oxide, nickel chloride, copper sulfate and iron chloride. Unless otherwise indicated in the following examples or elsewhere in the written description and/or claims, all parts and percentages are by weight, temperatures are in degrees centigrade and pressure is at or near atmospheric pressure.

TABLE I

| | Examples A–H | | | | | | | |
|---|---|---|---|---|---|---|---|---|
| Solution Example* | A | B | C | D | E | F | G | H |
| Zinc | 8.50 | 8.50 | 8.50 | 8.50 | 8.50 | 8.50 | 8.50 | 8.50 |
| Nickel | 3.10 | 3.10 | 3.10 | 3.10 | 3.10 | 3.10 | 3.10 | 3.10 |
| Copper | 0.25 | 0.25 | 0.25 | 0.25 | 0.25 | 0.25 | 0.25 | 0.25 |
| Iron | 0.30 | 0.30 | 0.30 | 0.30 | 0.30 | 0.30 | 0.30 | 0.30 |
| Sodium Hydroxide | 80.00 | 80.00 | 80.00 | 80.00 | 80.00 | 80.00 | 80.00 | 80.00 |
| Sodium Nitrate | 1.00 | 1.00 | 1.00 | 1.00 | 1.00 | 1.00 | 1.00 | 1.00 |
| Sodium Gluconate | 18.00 | 12.50 | 12.50 | 12.50 | 12.50 | 12.50 | 12.50 | 12.50 |
| Rochelle Salt | — | 7.50 | — | — | — | — | — | — |
| Monoethanolamine | — | — | 7.50 | 7.50 | 7.50 | 7.50 | 7.50 | 7.50 |
| 2-Mercaptobenzothiazole | 0.02 | — | 0.02 | — | — | — | — | — |
| 2,2'-dipyridyl | — | 0.02 | — | 0.02 | — | — | — | — |
| 1,10-phenantholine | — | — | — | — | 0.02 | — | — | — |
| 1,3-diethyl-2-thiourea | — | — | — | — | — | 0.02 | — | — |
| 2-benzimidazolethiol | — | — | — | — | — | — | 0.02 | — |
| Sodium thiocyanate | — | — | — | — | — | — | — | 0.02 |

*all parts in g/l, remainder is water

TABLE II

| | Example I–M | | | | |
|---|---|---|---|---|---|
| Solution Example* | I | J | K | L | M |
| Zinc | 7.00 | 4.45 | 4.50 | 4.45 | 4.45 |
| Nickel | 3.00 | 0.540 | 0.540 | 0.540 | 0.540 |
| Copper | 0.230 | 0.100 | 0.100 | 0.100 | 0.100 |
| Iron | 0.285 | 0.260 | 0.370 | 0.625 | 0.625 |
| Sodium Hydroxide | 75.00 | 42.00 | 42.00 | 42.00 | 42.00 |
| Sodium Nitrate | 1.25 | 0.800 | 0.800 | 0.825 | 0.825 |
| Sodium gluconate | 15.75 | 9.90 | 10.0 | 10.0 | 10.0 |
| Monoethanolamine | 6.25 | 5.00 | 3.30 | 3.30 | 3.30 |
| 2-Mercaptobenzothiazole | 0.02 | 0.01 | 0.01 | 0.01 | 0.015 |

TABLE II-continued

| Solution Example* | Example I–M | | | | |
|---|---|---|---|---|---|
| | I | J | K | L | M |
| 1,3-diethyl-2-thiourea | — | 0.01 | — | — | — |
| 2-mercapto-1-methylimidazole | — | — | 0.01 | 0.01 | 0.03 |

*all parts in g/l, remainder is water

The zincate solutions of the present invention which have been described above are useful in depositing alloy zincate coatings as a pretreatment for aluminum and various alloys of aluminum. In one embodiment, the zincate solutions of the present invention are free of cyanide ions, and such non-cyanide containing zincate solutions provide equivalent or superior results when compared to prior art zincate solutions containing cyanide ions. The use of the inhibitors, and the combination of the inhibitors and complexing agents described above in the zincate solutions is believed to be responsible, at least in part, for the improved performance of the alloying zincate solutions of the present invention. The inhibitors affect the zincate deposition rate and provide a thin even coating on the aluminum and aluminum alloys. Zincate coating weights of from about 2–6 mg/ft$^2$ can be obtained with the zincate solutions described herein.

In addition to aluminum, the zincate solutions of the present invention are useful for depositing a zincate coating on various aluminum alloys, including both cast and wrought alloys. Exemplary cast alloys include 356, 380 and 383 alloys. Exemplary wrought alloys include 1100,2024, 3003,3105,5052,5056,6061,6063, and 7075 type aluminum alloys.

In one embodiment, the deposition of the zincate coating utilizing the zincate solutions of the present invention comprises pre-treatment steps for an optional metal plating of the aluminum or aluminum alloy substrates using an electroless or electrolytic metal plating solution.

Single, double and triple zincate methods for preparing aluminum and aluminum alloys for subsequent metal plating are well known in the art. In general, any aluminum or aluminum alloy may be treated using the method and zincate solutions of the present invention. While the specific zincate and/or double-zincate pretreatment methods employed to deposit a zincate coating on aluminum may vary according to the alloys treated and the desired results, a typical zincating procedure used in the industry and in the following examples is described below. It should be understood that water rinses generally are employed after each processing step.

The first step in the pretreatment process is to clean the aluminum surface of any grease, dirt or oil utilizing, for example, suitable alkaline or acid non etch cleaners. Suitable cleaners include nonsilicated mildly alkaline cleaners and silicated mildly alkaline cleaners, both of which are used over a temperature range of about 49' to 66° C. for about 1 to about 5 minutes. After cleaning, the aluminum generally is rinsed in water.

Etching of the cleaned aluminum substrates then is performed using conventional etchants which may be either acidic or alkaline. An acidic etchant generally is used. In one embodiment, the etching solution may comprise 50% nitric acid. In the process utilized in the following Examples, the etching solution used to remove excessive oxide from the aluminum surface is Alklean AC-2 (5% vol) from Atotech USA, and this etching solution comprises phosphoric acid/sulfuric acid/fluoride. The aluminum or aluminum alloy is contacted with Alklean AC-2 for about one minute at about 20–25° C. The etched samples are then rinsed with water.

The etched aluminum surface is then desmutted. Desmutting is a process whereby excess grime is removed from the surface of the aluminum. Desmutting may be performed using a nitric acid solution (e.g., a 50% by volume solution) or a mixture of nitric acid and sulfuric acid. In one embodiment, a typical desmutting solution for aluminum alloys may contain 25% by volume sulfuric acid, 50% by volume nitric acid and 25% ammonium fluoride. Desmutting also can be accomplished with a mixture of nitric and sulfuric acids containing an acidic, fluoride salt product containing ammonium bifluoride. In the Examples which follow, the etched aluminum alloys were desmutted using DeSmutter NF (100 g/l) Atotech USA at a temperature of about 20–25° C. for about one minute and rinsed with water DeSmutter NF comprises a mixture of acid salts and a persulfate-based oxidizing agent.

A zincate coating is applied to the etched and desmutted aluminum substrate by immersion of the aluminum substrate in a zincate bath of the invention for a brief period of time such as from about 15 to about 60 seconds in order to obtain complete coverage of the aluminum substrate. The temperature of the solution of the zincating solution is generally maintained between about 20° C. and 5° C. Excess zincate solution is removed from the surface of the aluminum substrate, generally by a water rinse in deionized water. In the following Examples, the aluminum is immersed in the indicated zincate solution at 20–25° C. for about 45–50 seconds.

The above zincate coated aluminum substrates are then subjected to a stripping process, with, for example, a 50% nitric acid solution, or in Alumetch BD (40 g/l) from Atotech USA at a temperature of from about 20 to about 25° C. for about 30 seconds. Alumetch BD comprises a mixture of acid salts and a persulfate based oxidizing agent. Following a cold water rinse, the etched aluminum substrate then is subjected to a second immersion in the same zincate solution at a temperature of from about 20 to about 25° C. for about 25 to 30 seconds. The double zincated aluminum substrate then is removed from the zincate bath zincate solution and rinsed with water to remove excess zincate solution from the aluminum substrate.

Following the above described zincate treatment, the zincate coated aluminum substrates may be plated with any suitable metal utilizing electroless or electrolytic plating processes well known in the art. Suitable metals include nickel, copper, bronze, brass, silver, gold, and platinum. In one embodiment, the zincate treated aluminum substrates are plated in electroless nickel or by electrolytic plating processes such as sulfamate nickel strike or copper pyrophosphate strike solutions.

The following Examples 1–14 illustrate the deposition of a zincate coating in accordance with the present invention on various aluminum alloys followed by metal plating. Test plaques of the aluminum alloys of 1 inch by 4 inch with a thickness of 0.09–0.25 inch are used for the plating tests. Metal layers are plated up to about 1 mil or somewhat thicker prior to the adhesion test. In Examples 1–11, the zincated samples are plated with nickel utilizing Nichem-2500 (Atotech USA) electroless nickel bath for 70 minutes at about 95° C. In Example 12, the zincated samples are plated electrolytically in a copper pyrophosphate solution. The zincated samples of Example 13 are plated in a sulfamate nickel electrolytic strike bath followed by bright acid copper, bright nickel and decorative chromium electroplating steps. The plated samples are then rinsed with water, dried, and tested for adhesion of the nickel or other plated metal to the aluminum substrate. Adhesion of the plated metal is determined using one or more of the following tests. One test involves using a 90 bend test. In this test, after a 90' bending of the plated sample, inside and outside surfaces of the bent area are checked for lift-off (flaking) of the plated metal from the base aluminum substrate. Adhesion of plated metal is rated as: Good (0% lift-off), Marginal (less than 10% lift-off on either side of the bent area) and Poor (greater than 20% lift-off). For cast alloys, "Reverse Saw", "Grinding" and "Scribe/Cross-Hatch" methods are used to check the adhesion of the plated metal, and the adhesion is rated using the above criteria. Some plated samples also are tested after baking at 150° C. for two hours, quenched in cold water (20° C.), and the plated surface is then analyzed for blisters using a "no blister/pass" and "blister(s)/fail" criteria.

EXAMPLES 1–10

The zincate solutions of Examples C–L are used to deposit a zincate coating on wrought aluminum alloys 2024 and 6061. Slight precipitates are observed in the solution of Examples F, G and I–K while no precipitates were observed in the remaining solutions. The zincated aluminum alloys are then plated in Nichem-2500 (Atotech USA) electroless nickel bath for 70 minutes at about 95° C. The plated samples are rinsed with water, dried, and tested for adhesion using the 90 bend test described above. The results are summarized in the following Table III.

TABLE III

| 90° Bend Adhesion Test Results | | | |
|---|---|---|---|
| Example | Zincate Solution of Example | 2024 Alloy | 6061 Alloy |
| 1 | C | Good | Good |
| 2 | D | Good | Marginal |
| 3 | E | Good | Marginal |
| 4 | F | Good | Good |
| 5 | G | Good | Good |
| 6 | H | Good | Marginal |
| 7 | I | Good | Good |
| 8 | J | Good | Good |
| 9 | K | Good | Good |
| 10 | L | Good | Good |

EXAMPLE 11

Aluminum alloys including cast alloys 356, 380 and 383, and wrought alloys including 1100, 2024, 3003, 5052, 6061 and 7075 are zincate coated using the zincate solution of Example M followed by electroless nickel plating. The nickel-plated parts are tested for adhesion, and no adhesion failure is observed in any of the parts processed.

EXAMPLE 12

Aluminum alloys 2024 and 6061 are zincate coated using the zincate solution of Example M by the procedure described above. The zincate coated samples are then plated electrolytically in a copper pyrophosphate bath. The copper plated samples are tested for adhesion of the plated copper to the aluminum alloy, and no adhesion failure is noticed in the 90' bend test.

EXAMPLE 13

The procedure of Example 9 is repeated except that the zincated parts are plated in a sulfamate nickel electrolytic strike bath followed by bright acid copper, bright nickel and decorative chromium electroplating steps. These electroplated samples are tested for adhesion using the 90' bend test as well as the baking test described above. No adhesion loss or blisters on the plated surface are observed on any of the plated samples.

EXAMPLE 14

This example illustrates the effect of the inhibitor on the zincate deposition rate. The zincate solution of Example L is utilized to deposit a zincate coating on aluminum alloy 6061 (four samples). The aluminum alloy test samples are immersed in the zincate solution for a period of one minute at about 24° C., rinsed with water and air dried. The zincated samples are weighed using an analytical balance, and the weight of the individual test coupon is recorded. After weight measurement, the zincate layer is stripped from the samples by immersion of the samples in a 50% nitric acid solution for one minute. The stripped samples are then rinsed and air dried, and the dried samples are weighed again and the weight of the stripped samples recorded. The zincate weight is obtained from the difference of the weight before and after stripping of the zincated samples. The average weight of the zincate deposited by the solution of Example L is 4.43 mg/ft$^2$.

When the above procedure is repeated with a zincate solution similar to Example L except that the solution does not contain the two inhibitors, namely, 2-mercaptobenzothiazole and 2-mercapto-1-methylimidazole, the zincate coating weight is found to be 7.7 mg/ft$^2$. These results indicate that the inhibitors have a strong influence on the deposition rate of zincate. In the presence of the inhibitors, the zincate solutions form a thin zincate layer which is important for the adhesion of the plated metal over the zincated aluminum. Thicker zincate layers lead to adhesion failure.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for depositing a zincate coating on aluminum or aluminum based alloy substrates which comprises (A) immersing an aluminum or aluminum based alloy substrate in an aqueous alkaline zincate solution comprising hydroxide ions, zinc ions, nickel and/or cobalt ions, iron ions, copper ions and at least one inhibitor containing one or more nitrogen atoms, one or more sulfur atoms, or both sulfur and nitrogen atoms provided said nitrogen atoms are not present in an aliphatic amine or hydroxylamine and the inhibitor is selected from the group consisting of nitrogen-containing disulfides: alkali metal thiocyanates; thiocarbamates; nitrogen-containing heterocyclic compounds; mercapto substituted nitrogen-containing heterocyclic compounds; thioacids; thioalcohols; compounds characterized by the formula $$R_2N—C(S)Y$$

wherein each R is independently hydrogen or an alkyl, alkenyl, or aryl group, and Y is $XR^1$, NR, or $N(H)NR_a$; wherein X is O or S and $R^1$ is hydrogen or an alkali metal; and mixtures thereof for a period of time sufficient to deposit the desired coating, and (B) removing the coated substrate from the zincate solution.

2. The process of claim 1 wherein the surface of the aluminum or aluminum based alloy is cleaned, etched and desmutted prior to immersion in the zincate solution.

3. The process of claim 2 wherein the cleaning is performed with an alkaline cleaner, and the etching is performed with an alkaline or acid etching solution.

4. The process of claim 1 wherein after immersion in the zincate solution to form a first zincate coating, the coated aluminum or aluminum alloy is withdrawn from the zincate solution, the coating is at least partially stripped with acid, and the aluminum or aluminum alloy is immersed in the zincate solution to form a second zincate coating.

5. The process of claim 4 wherein the aluminum or aluminum alloy is rinsed with water after each of the cleaning, etching, desmutting, zincating and stripping with acid steps.

6. A zincate coated aluminum or aluminum alloy obtained in accordance with the process of claim 1.

7. A process for depositing a zincate coating on aluminum or aluminum based alloy substrate which comprises (A) immersing the substrate in an aqueous alkaline zincate solution comprising hydroxide ions, zinc ions, nickel and/or cobalt ions, iron ions, copper ions, nitrate ions, at least one inhibitor containing nitrogen atoms, sulfur atoms, or both sulfur and nitrogen atoms provided said nitrogen atoms are not present in an aliphatic amine or aliphatic hydroxylamine, and the inhibitor is selected from the group consisting of nitrogen-containing disulfides; alkali metal thiocyanates; thiocarbamates; nitrogen-containing heterocyclic compounds; mercapto substituted nitrogen-containing heterocyclic compounds; thioacids; thioalcohols; compounds characterized by the formula $$R_7N—C(S)Y$$

wherein each R is independently hydrogen or an alkyl, alkenyl, or aryl group, and Y is $XR^1$, $NR_2$ or $N(H)NR_2$; wherein X is O or S and $R^1$ is hydrogen or an alkali metal; and mixtures thereof and at least one metal complexing agent for a period of time sufficient to deposit the desired coating, and (B) removing the coated substrate from the zincate solution.

8. The process of claim 7 wherein the surface of the substrate is cleaned, etched and desmutted prior to immersion in the zincate solution.

9. The process of claim 8 wherein the cleaning is performed with an alkaline cleaner, and the etching is performed with an alkaline or acid etching solution.

10. The process of claim 7 wherein after immersion in the zincate solution to form a first zincate coating, the coated substrate is withdrawn from the zincate solution, the coating is at least partially stripped with acid, and the aluminum or aluminum alloy is re-immersed in the zincate solution to form a second zincate coating.

11. The process of claim 10 wherein the substrate is rinsed with water after each of the cleaning, etching, desmutting, zincating and stripping with acid steps.

12. A zincate coated aluminum or aluminum alloy obtained in accordance with the process of claim 7.

13. A process for depositing a zincate coating on aluminum or aluminum based alloy substrate which comprises (A) immersing the substrate in an aqueous alkaline zincate solution comprising:

from about 5 to about 300 g/l of hydroxide ions, from about 1 to about 30 g/l of zinc ions, from about 0.1 to about 5.0 g/l of iron ions, from about 0.01 to about 10 g/l of copper ions, from about 0.05 to about 20 g/l of nickel and/or cobalt ions, from about 0.001 to about 10 g/l of an inhibitor selected from the group consisting of nitrogen-containing disulfides; alkali metal thiocyanates; thiocarbamates; nitrogen-containing heterocyclic compounds; mercapto substituted nitrogen-containing heterocyclic compounds; thioacids; thioalcohols; compounds characterized by the formula $$R_2N—C(S)Y$$

wherein each R is independently hydrogen or an alkyl, alkenyl, or aryl group, and Y is $XR^1$, $NR_2$ or $N(H)NR_2$; wherein X is O or S and $R^1$ is hydrogen or an alkali metal; and mixtures thereof from about 0.01 to about 10 g/l of an alkali metal nitrate, and from about 1 to about 250 g/l of at least one metal complexing agent for a period of time sufficient to deposit the desired coating, and (B) removing the coated substrate from the zincate solution.

14. The process of claim 13 wherein the surface of the substrate is cleaned, etched and desmutted prior to immersion in the zincate solution.

15. The process of claim 14 wherein the cleaning is performed with an alkaline cleaner, and the etching is performed with alkaline or acid etching solution.

16. The process of claim 13 wherein after immersion in the zincate solution to form a first zincate coating, the coated substrate is withdrawn from the zincate solution, the coating is at least partially stripped with acid, and the aluminum or aluminum alloy is re-immersed in the zincate solution to form a second zincate coating.

17. The process of claim 16 wherein the substrate is rinsed with water after each of the cleaning, etching, desmutting, zincating and stripping with acid steps.

18. A zincate coated aluminum or aluminum alloy obtained in accordance with the process of claim 11.

19. A process for depositing a metal coating on an aluminum or aluminum alloy substrate comprising (A) applying an immersion zincate coating on the substrate by immersing the substrate in an aqueous alkaline zincate solution comprising hydroxide ions, zinc ions, nickel and/or cobalt ions, iron ions, copper ions and at least one inhibitor containing one or more nitrogen atoms, one or more sulfur atoms, or both sulfur and nitrogen atoms provided said nitrogen atoms are not present in an aliphatic amine or hydroxylamine, and the inhibitor is selected from the group consisting of nitrogen-containing disulfides; alkali metal thiocyanates; thiocarbamates nitrogen-containing heterocyclic compounds; mercapto substituted nitrogen-containing heterocyclic compounds; thioacids; thioalcohols; compounds characterized by the formula $$R_2N—C(S)Y$$

wherein each R is independently hydrogen or an alkyl, alkenyl, or aryl group, and Y is $XR^1$, $NR_2$, or $N(H)NR_2$; wherein X is O or S and $R^1$ is hydrogen or an alkali metal; and mixtures thereof (B) plating the zincate coated substrate using an electroless or electrolytic metal plating solution.

20. The process of claim 19 wherein the surface of the substrate is subjected to alkaline cleaning, acid etching and desmutting, prior to immersion in the zincate solution.

21. The process of claim 20 wherein the cleaning is performed with an alkaline cleaner, and the etching is performed with alkaline or acid etching solution.

22. The process of claim 19 wherein after immersion in the zincate solution to form a first zincate coating, the coated substrate is withdrawn from the zincate solution, the coating is at least partially stripped with add, and the aluminum or aluminum alloy is re-immersed in the zincate solution to form a second zincate coating.

23. The process of claim 22 wherein the substrate is rinsed with water after each of the cleaning, etching, desmutting, zincating and stripping with acid steps.

24. A metal coated aluminum or aluminum alloy obtained in accordance with the process of claim 19.

25. The process of claim 1 wherein the inhibitor is a thiourea compound represented by the formula:

$$[R_2N]_2CS \qquad \text{II}$$

wherein each R is independently hydrogen or an alkyl, alkenyl or arty group.

26. The process of claim 1 wherein the inhibitor is a thiocarbamate represented by the formula:

$$R_2NC(S)\text{-}XR^1 \qquad \text{III}$$

wherein each R is independently hydrogen, or an alkyl, alkenyl or aryl group, X is O or S, and $R^1$ is hydrogen or an alkali metal.

27. The process of claim 1 wherein the inhibitor is a thiosemicarbazide represented by the formula $$R_2N\text{—}C(S)\text{—}N(H)NR_2 \qquad \text{IV}$$

wherein each R is independently hydrogen, or an alkyl, alkenyl or aryl group.

28. The process of claim 1 wherein the inhibitor is a disulfide compound having the formula:

$$[R_2NCS_2]_2 \qquad \text{V}$$

wherein each R is independently hydrogen, or an alkyl alkenyl or aryl group.

29. The process of claim 1 wherein the inhibitor is at least one nitrogen containing heterocyclic compound or mercapto substituted nitrogen containing heterocyclic compound, or mixtures thereof, and the heterocyclic compound is selected from the group consisting of pyrroles, imidazoles, benzimidazoles, pyrazoles, triazoles, pyridines, piperazines, pyrazines, piperidines, pyrimidines, thiazoles, thiazolines, thiazolidines, rhodanines, and morpholines.

30. The process of claim 1 wherein the inhibitor is a mercapto substituted nitrogen containing heterocyclic compound.

31. The process of claim 1 wherein the solution also contains one or more metal complexing agents.

32. The process of claim 1 wherein the zincate solution (A) is free of cyanide ions.

33. The process of claim 1 wherein the zincate solution (A) also contains nitrate ions.

34. The process of claim 7 containing, as a metal complexing agent, an aliphatic amine, an aliphatic hydroxylamine, or mixtures thereof.

35. The process of claim 7 containing, as a metal complexing agent, an acetate, citrate, glycollate, lactate, maleate, pyrophosphate, tartrate, gluconate, or glucoheptonate, and mixtures thereof.

36. The process of claim 7 wherein the inhibitor is a thiourea compound represented by the formula:

$$[R_2N]_2CS \qquad \text{II}$$

wherein each R is independently hydrogen or an alkyl, alkenyl or aryl group.

37. The process of claim 7 wherein the inhibitor is a disulfide compound having the formula:

$$[R_2NCS_2]_2 \qquad \text{V}$$

wherein each R is independently hydrogen, or an alkyl, alkenyl or aryl group.

38. The process of claim 7 wherein the inhibitor is at least one nitrogen containing heterocyclic compound or a mercapto substituted nitrogen containing heterocyclic compound, or mixtures thereof and the heterocyclic compound is selected from the group consisting of pyrroles, imidazoles, pyrazoles, triazoles, tetrazoles, thiazoles, thiazolines, thiazolidines, pyridines, piperazines, pyrazines, piperidines, pyrimidines, and morpholines.

39. The process of claim 7 wherein the zincate solution (A) is free of cyanide ions.

40. The process of claim 38 wherein the inhibitor is a mercapto substituted nitrogen containing heterocyclic compound.

* * * * *